US011851240B2

(12) United States Patent
Mello

(10) Patent No.: US 11,851,240 B2
(45) Date of Patent: Dec. 26, 2023

(54) REMOVABLE WRAP FOR DECORATING BOTTLES AND OTHER OBJECTS

(71) Applicant: Tracy Mello, Concord, NC (US)

(72) Inventor: Tracy Mello, Concord, NC (US)

( * ) Notice: Subject to any disclaimer, the term of this patent is extended or adjusted under 35 U.S.C. 154(b) by 280 days.

(21) Appl. No.: 16/932,742

(22) Filed: Jul. 18, 2020

(65) Prior Publication Data

US 2022/0017265 A1 Jan. 20, 2022

(51) Int. Cl.
*B65D 23/08* (2006.01)

(52) U.S. Cl.
CPC ..... *B65D 23/0842* (2013.01); *B65D 2203/02* (2013.01)

(58) Field of Classification Search
CPC ..... B65D 23/0842; B65D 23/0871; B65D 2203/02
USPC ..... 229/87.01, 89–91
See application file for complete search history.

(56) References Cited

U.S. PATENT DOCUMENTS 763,128 A * 6/1904 Trumpour ..... G09F 3/04 40/310
3,680,726 A * 8/1972 Massey ..... B65D 23/0842 215/12.2
3,965,590 A * 6/1976 Algaze ..... G09F 3/00 473/44
3,996,879 A * 12/1976 Walton ..... G09F 7/00 206/534
4,583,577 A * 4/1986 Canfield ..... B65D 81/3879 150/901
4,951,596 A * 8/1990 Wallace, Jr. ..... G09F 3/16 116/323
5,358,770 A * 10/1994 Evans ..... B44C 5/00 40/310
5,816,631 A * 10/1998 Kochan ..... B65D 23/106 215/396
6,360,913 B1 * 3/2002 Bruinsma ..... A47G 23/0216 220/737
6,594,928 B1 * 7/2003 Clawson ..... B65D 25/20 359/809
7,905,037 B1 * 3/2011 Holland ..... G09F 23/06 40/310

(Continued)

FOREIGN PATENT DOCUMENTS

DE 20204429 U1 * 10/2002 ..... B65D 23/0842
ES 1069946 U * 5/2009
GB 2408730 A * 6/2005 ..... B65D 23/0842

*Primary Examiner* — Jes F Pascua
(74) *Attorney, Agent, or Firm* — Tillman, Wright & Wolgin; James D. Wright; David R. Higgins

(57) ABSTRACT

A bottle decorated with a removable wrap includes a bottle and a removable wrap. The wrap includes a thin resilient planar body that is curved such that the body forms a structure resembling a portion of a cylinder. A decorative treatment is applied to the body. In a first state, the wrap is separated from the bottle, and the cylindrical structure is in a natural/default state and has a first radius. In a second state, the wrap is separated from the bottle, and the cylindrical structure is in a spread state and has a second radius. In a third state, the wrap is mounted around the bottle, the cylindrical structure is in a partially-spread mounting state and has a third radius such that bias in the partially-spread body is applied to the bottle. The second radius is larger than the third radius which is larger than the first radius.

4 Claims, 8 Drawing Sheets

(56) References Cited

U.S. PATENT DOCUMENTS

| | | | | |
|---|---|---|---|---|
| 2001/0027979 | A1* | 10/2001 | Canfield | B65D 81/389<br>220/739 |
| 2007/0062277 | A1* | 3/2007 | Miller | A47G 23/14<br>73/426 |
| 2013/0206624 | A1* | 8/2013 | Riley | A45D 40/12<br>206/385 |
| 2014/0048509 | A1* | 2/2014 | O'Brien | B29D 22/003<br>215/386 |

* cited by examiner

100

REMOVABLE WRAP FOR DECORATING BOTTLES AND OTHER OBJECTS

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to wrapping or decorating gifts for presentation, and, in particular, to decorating wine bottles and similar objects to be given as gifts.

Background

A bottle of wine has long served as a popular gift for a variety of occasions. Wine bottles are used as housewarming gifts, hostess gifts, wedding gifts, birthday gifts, and the like. Although a wine bottle is often gifted in an unwrapped state, the presenter sometimes chooses to wrap, decorate, or otherwise personalize the bottle in some manner. Most commonly, a tag of some sort, often with a personalized greeting, may be attached to the bottle, the wine bottle may be placed in a special gift bag of any of an infinite variety of designs, or both. Although these approaches are acceptable, the tag or bag is typically separated or removed from the bottle for use, at which point the bottle loses the festive appearance provided thereby. Thus, a new approach to decorating wine bottles and other gifts would be useful.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

The present invention includes many aspects and features. Moreover, while many aspects and features relate to, and are described in, the context of decorating a wine bottle or similar object, the present invention is not limited to use only in decorating wine bottles and similar objects, as will become apparent from the following summaries and detailed descriptions of aspects, features, and one or more embodiments of the present invention Broadly defined, the present invention according to one aspect relates to a removable wrap for decorating bottles and other objects, including: a thin resilient planar body that is curved such that the body forms a structure resembling a portion of a cylinder, the body having an outer surface and an inner surface; and a decorative treatment applied to the outer surface of the body; wherein in a first state, the cylindrical structure that is partially formed by the body is in a natural or default state and has a first radius; wherein in a second state, the cylindrical structure that is partially formed by the body is in a spread state and has a second radius, the second radius being greater than the first radius; and wherein in a third state, the cylindrical structure that is partially formed by the body is in a partially-spread mounting state and has a third radius, the third radius being greater than the first radius but less than the second radius such that bias in the partially-spread curved resilient planar body may be applied to an object around which the body is wrapped.

In a feature of this aspect, in the third state, the cylindrical structure that is partially formed by the body has a cross-section that forms a geometric major arc of a circle whose radius equals the third radius such that the partially-spread curved resilient planar body extends more than halfway around an object around which the body is wrapped.

In another feature of this aspect, the arc subtends an angle between 185 degrees and 240 degrees inclusive. In a further feature, the arc subtends an angle between 210 degrees and 230 degrees inclusive.

In another feature of this aspect, the thin resilient planar body has a thickness of between 1/40 inch and 1/16 inch inclusive. In further features, in the first state, which is the natural or default state, the radius the cylindrical structure is between 1¼ inch and 1½ inch, inclusive; in the first state, which is the natural or default state, the radius the cylindrical structure is between 1.3 inch and 1.4 inch, inclusive; the body is formed from a sheet metal; the decorative treatment includes a decorative adhesive sticker applied to the body; and/or the decorative treatment includes at least one of a design stamped treatment, a stamp punched treatment, an embossed design, a screen printed design, a color laser printed design, and a color etching.

Broadly defined, the present invention according to another aspect relates to a bottle decorated with a removable wrap, including: a bottle; and a removable wrap, having: a thin resilient planar body that is curved such that the body forms a structure resembling a portion of a cylinder, the body having an outer surface and an inner surface, and a decorative treatment applied to the outer surface of the body; wherein in a first state, the wrap is separated from the bottle, and the cylindrical structure that is partially formed by the body is in a natural or default state and has a first radius; wherein in a second state, the wrap is separated from the bottle, and the cylindrical structure that is partially formed by the body is in a spread state and has a second radius, the second radius being greater than the first radius; and wherein in a third state, the wrap is mounted around the bottle, and the cylindrical structure that is partially formed by the body is in a partially-spread mounting state and has a third radius, the third radius being greater than the first radius but less than the second radius such that bias in the partially-spread curved resilient planar body is applied to the bottle.

Broadly defined, the present invention according to another aspect relates to a method of decorating a bottle or other object, including: producing a flat body of a thin resilient material; curving the flat body to produce a thin resilient planar body that forms a structure resembling a portion of a cylinder, the body having an outer surface and an inner surface, wherein in a first state, the cylindrical structure that is partially formed by the body is in a natural or default state and has a first radius, wherein in a second state, the cylindrical structure that is partially formed by the body is in a spread state and has a second radius, the second radius being greater than the first radius, and wherein in a third state, the cylindrical structure that is partially formed by the body is in a partially-spread mounting state and has a third radius, the third radius being greater than the first radius but less than the second radius; applying a decorative treatment to the outer surface of the body; spreading sides of the body open such that the cylindrical structure that is partially formed by the body is in the second or spread state and has the second radius; and releasing the body until the cylindrical structure that is partially formed by the body is in the third or partially-spread mounting state, and has the third radius, such that the wrap is mounted around the bottle or other object and held in place by forces created by the bias of the resilient body against the bottle or other object.

Further areas of applicability of the present invention will become apparent from the detailed description provided hereinafter. It should be understood that the detailed description and specific examples, while indicating preferred embodiment(s) of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
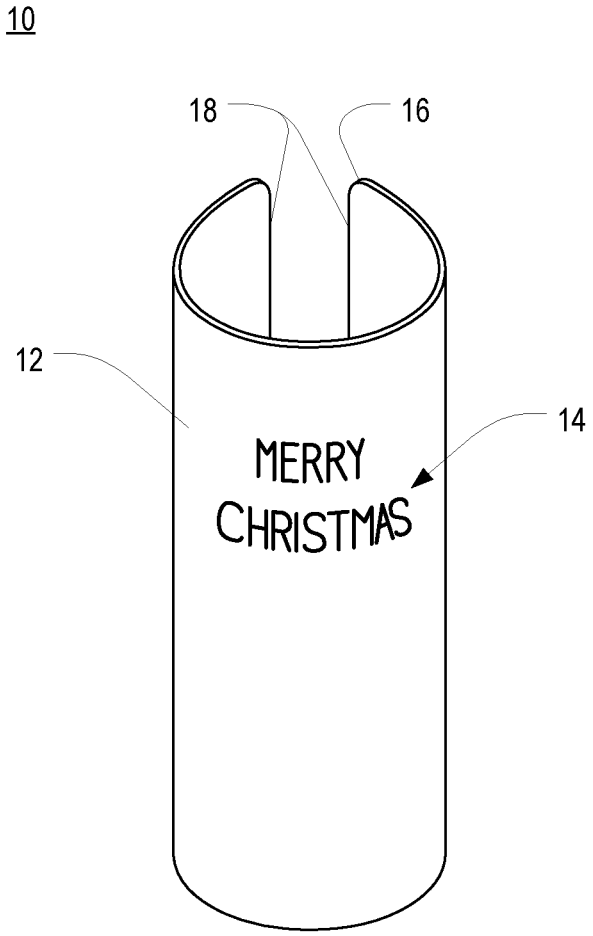
FIG. 1 is a front perspective view of a decorative wrap for wine bottles in accordance with one or preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Furthermore, an embodiment of the invention may incorporate only one or a plurality of the aspects of the invention disclosed herein; only one or a plurality of the features disclosed herein; or combination thereof. Moreover, many embodiments, including adaptations, variations, modifications, and equivalent arrangements, are implicitly disclosed herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Further, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a front perspective view of a decorative wrap 10 for wine bottles in accordance with one or preferred embodiments of the present invention. The wrap 10 includes a thin resilient planar body 12 and a decorative treatment 14. The thin resilient planar body 12 is manufactured such that, in its natural or default state, it has a generally cylindrical shape whose diameter is somewhat smaller than the diameter of an object to which it is to be mounted, but the body 12 is resilient enough that it can be spread open temporarily to fit around the object. The planar body may be produced from sheet metal, various plastics, or the like. In at least some embodiments, the planar body 10 is produced from sheet metal that is 24 gauge to 16 gauge (1/40 inch to 1/16 inch) in thickness. Suitable sheet metal materials may include aluminum, brass, copper, steel, tin, nickel, titanium, and the like. In some embodiments, the decorative treatment 14 may include colors, designs, cutouts, textures, or the like that are integrally manufactured as part of the thin planar body. In some embodiments, the decorative treatment 14 may include colors, designs, cutouts, textures, or the like that are applied to a separately-manufactured thin planar body. In some embodiments, the decorative treatment 14 may include a thin sheet of paper, plastic, or other material that is adhered or otherwise attached to the thin resilient planar body 12, wherein the thin sheet may include laser printed text, colors, designs, and/or the like that are applied to the thin sheet before attachment to the thin resilient planar body 12, cutouts, or the like.

Figure 2:
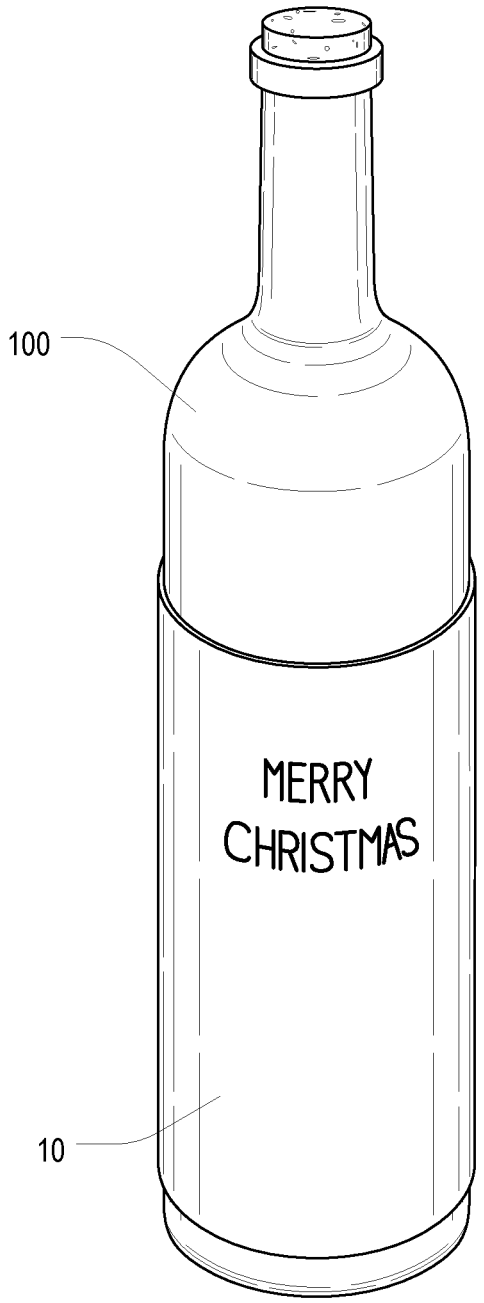
FIG. 2 is front perspective view of a decorative wrap installed around a bottle in accordance with one or preferred embodiments of the present invention.

FIG. 2 is front perspective view of a decorative wrap 10 installed around a bottle 100 in accordance with one or preferred embodiments of the present invention. Because the diameter of the body 12 in its natural or default state is less than the diameter of the bottle 100, and the body 12 stretches around somewhat more than half (180 degrees) of the circumference of the bottle 100, the body 12 is biased with some amount of force against the sides of the bottle 100. So long as the biasing force in combination with the frictional force of the wrap 10 against the bottle 100 is sufficient, the wrap 10 will remain in place on the bottle 100. However, the wrap 10 may be removed if force is applied to the body 12 in an amount sufficient to spread it open and pull it off of the bottle 100.

Figure 3:
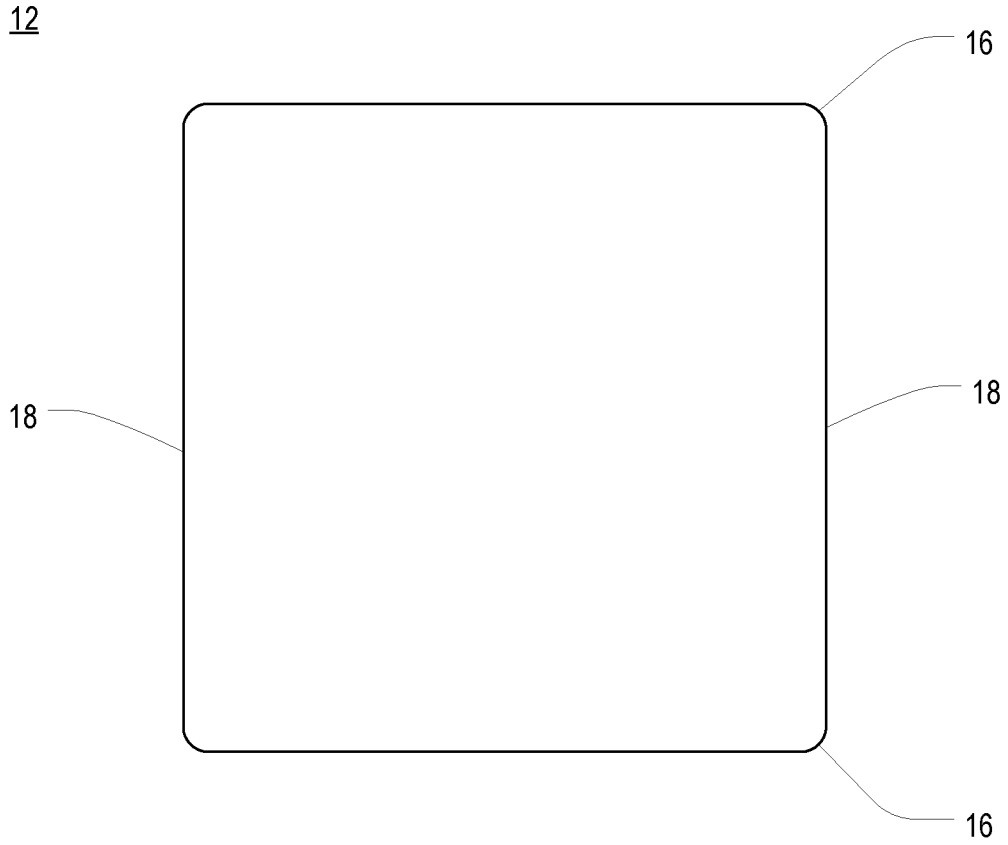
FIG. 3 is a front view of the decorative wrap, shown in a flat state.
Figure 10:
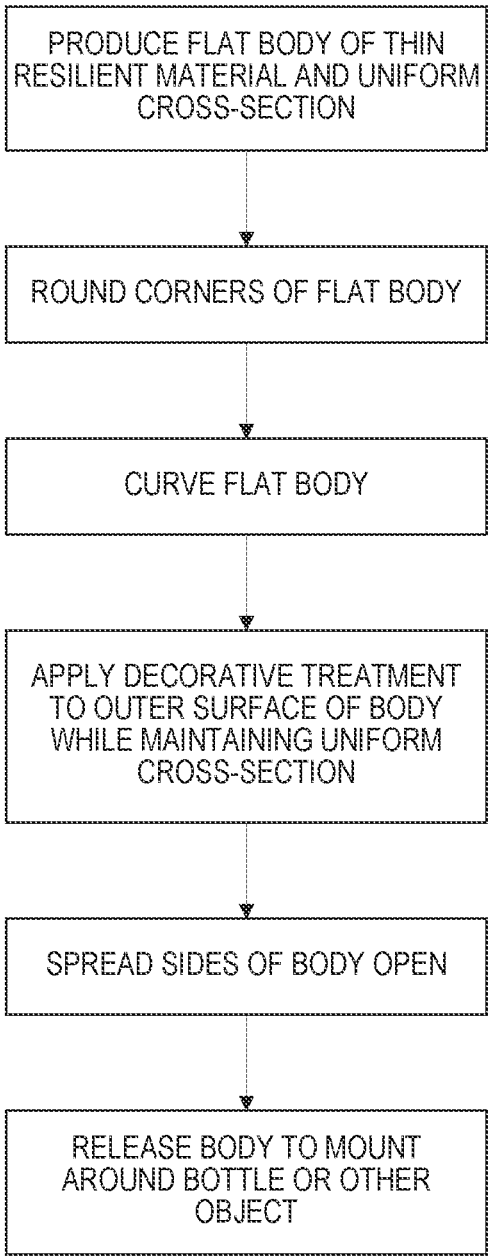
FIG. 10 is a flowchart illustration of a method of decorating a bottle or other object in accordance with one or more preferred embodiments of the present invention.

The wrap 10 is relatively easy to manufacture. FIG. 10 is a flowchart illustration of a method of decorating a bottle or other object in accordance with one or more preferred embodiments of the present invention. Sheet metal stock may be cut, stamped, formed, or otherwise worked to produce a flat body as shown in FIG. 3, which is a front view of the decorative wrap 10, shown in a flat state. In at least some embodiments, a 12-inch bench shear is utilized to produce the body 12, including the round corners 16. The flat body 12 may then be curved to produce the desired cylindrical/semi-cylindrical shape using any of a variety of techniques. In at least some embodiments, the curvature is produced using a 12-inch slip roll machine. The decorative treatment 14 may be inherent in the material of the body 12, but if further decorative treatment 14 is to be applied, it may be applied to the sheet material prior to creation of the individual body 12, after manufacture of the flat body 12 but before curvature is applied, or after curvature is applied. Any conventional decorative treatment technique may be utilized, including design stamping, stamp punching, embossing, screen printing, color laser printing, color etching, and the like, with the particular technique(s) being dependent on the desired decorative treatment 14.

Figure 4:
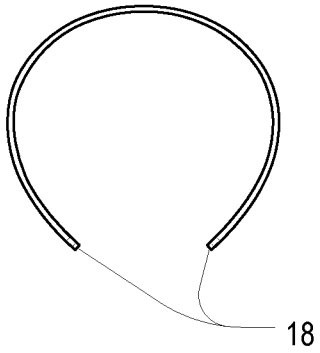
FIG. 4 is a top view of the wrap of FIG. 1.
Figure 5:
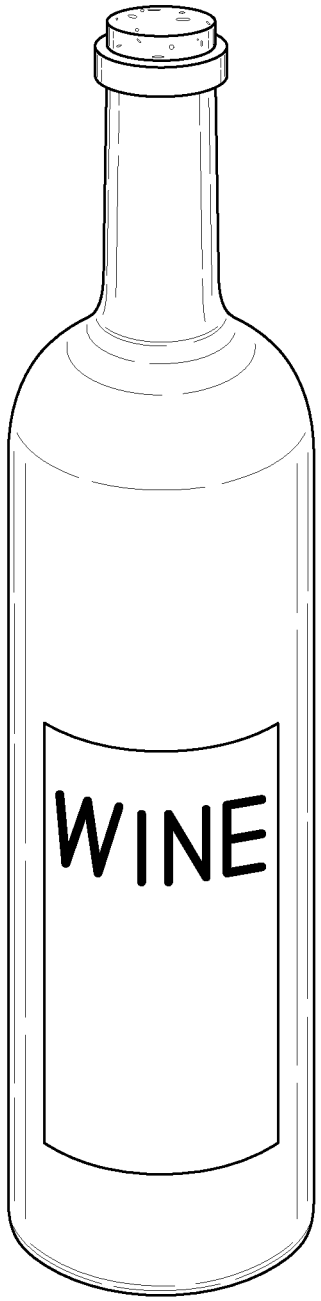
FIG. 5 is a front perspective view of a wine bottle on which the wrap of FIG. 1 is to be mounted.
Figure 6:
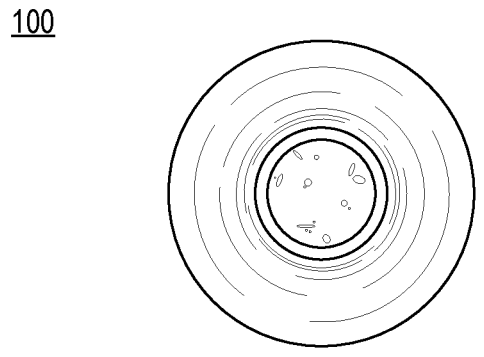
FIG. 6 is a top view of a wine bottle on which the wrap of FIG. 1 is to be mounted.
Figure 7:
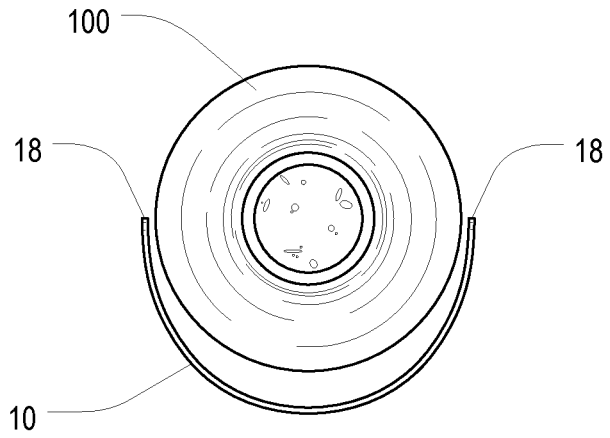
FIG. 7 is a top view of the wrap of FIG. 1 being spread open for mounting around the wine bottle of FIG. 6.
Figure 8:
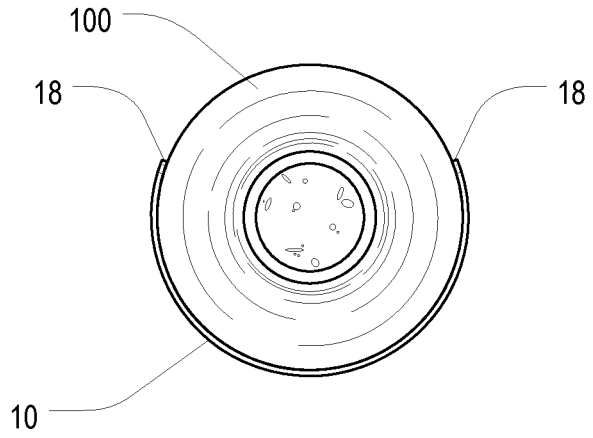
FIG. 8 is a top view of the mounted wrap and wine bottle of FIG. 2.
Figure 11:
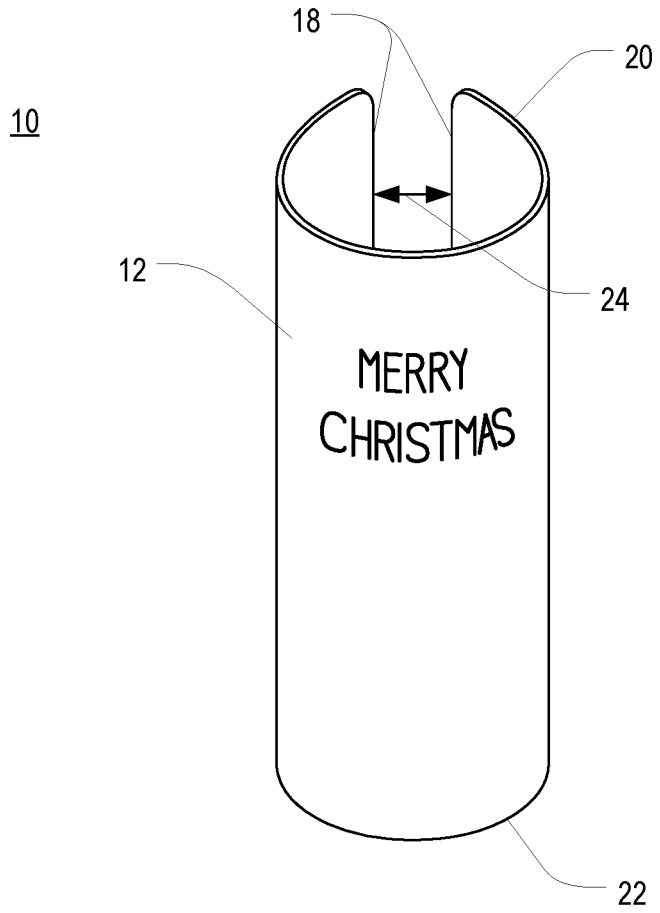
FIG. 11 is a front perspective view of the decorative wrap of FIG. 1, illustrating top, bottom, and gap thereof.
Figure 12:
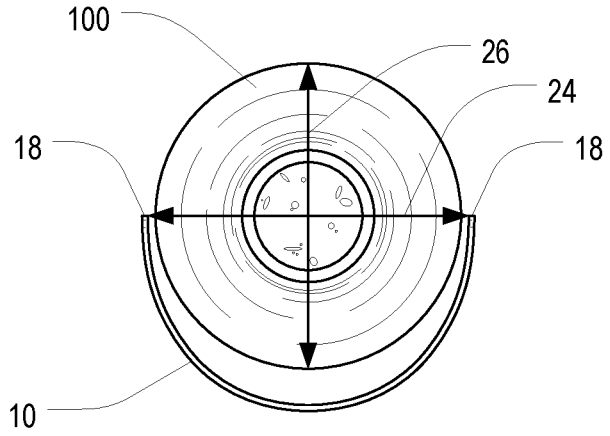
FIG. 12 is a top view of the wrap and wine bottle of FIG. 7, illustrating relative size of the gap and diameter of the wine bottle.

Mounting the wrap 10 to the bottle 100 is straightforward. FIG. 11 is a front perspective view of the decorative wrap 10 of FIG. 1, illustrating top 20, bottom 22, and gap 24 thereof, wherein the gap 24 is the linear distance between open sides 18 of the wrap 10. FIG. 4 is a top view of the wrap 10 of FIG. 1. In this state, the radius of curvature of the wrap 10 is relatively small. FIGS. 5 and 6 are a front perspective view and a top view, respectively, of a wine bottle 100 on which the wrap of FIG. 1 is to be mounted. The wrap 10 of FIG. 4 may be mounted around the bottle 100 by spreading the sides 18 open slightly as shown in FIG. 7, which is a top view of the wrap 10 of FIG. 1 being spread open for mounting around the wine bottle 100 of FIG. 6. With reference to FIG. 12, when spread open such that the size of the gap 24 is at least as large as the diameter 26 of the wine bottle 100, the wrap 10 may be forced around the side of the bottle as shown therein. In this spread state, the wrap 10 may be maneuvered around the wine bottle 100 until the desired position is reached. At this point, the wrap 10 may be released, allowing the natural bias of the wrap body 12 to hold the wrap 10 securely around the bottle 100. In this regard, FIG. 8 is a top view of the mounted wrap 10 and wine bottle 100 of FIG. 2.

Figure 9:
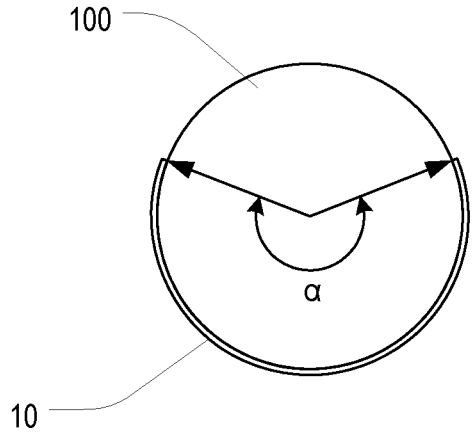
FIG. 9 is a partially schematic top view of the wrap and bottle of FIG. 2 showing the angular relationship between the wrap and the bottle.

FIG. 9 is a partially schematic top view of the wrap 10 and bottle 100 of FIG. 2 showing the angular relationship between the wrap 10 and the bottle 100. As shown therein, the wrap 10 effectively forms a geometric arc around the circle formed by the bottle 100. The arc is a major arc that subtends an angle $\alpha$. The angle $\alpha$ is greater than 180 degrees. Preferably, the angle $\alpha$ is between 185 degrees and 240 degrees inclusive, and more preferably, the angle $\alpha$ is between 210 degrees and 230 degrees inclusive. In a contemplated commercial embodiment, the angle $\alpha$ is about 220 degrees. Notably, when removed from the bottle 100, the radius of the cylindrical structure formed by the thin resilient planar body 12 will shrink somewhat, and the angle $\alpha$ will increase, due to the natural bias of the body 12 as it returns to its natural or default state. Furthermore, when the wrap 10 is spread open, the radius of the cylindrical structure formed by the thin resilient planar body 12 will increase somewhat and the angle $\alpha$ will decrease.

Notably, the wrap 10 may be positioned so that it is centered on the wine producer's existing label, as shown by FIGS. 2 and 5, thus providing a finished aesthetic appearance. In at least some embodiments, the decorative feature 14 may include a message, such as a greeting (e.g., "MERRY CHRISTMAS"), a congratulatory message, a name, or the like. In at least one commercial embodiment, wraps 10 may be produced with a customized message and/or design, and/or wraps 10 may be produced without such message or design but sold with an adhesive sticker or other separately-applied decorative feature 14 that may be added to the wrap 10 by the purchaser. Furthermore, the wrap 10 is not limited to use with wine bottles 100, and may in some cases be used with other objects having a cylindrical shape, such as candles, drink cans, jars, bottles, food items, and the like. In at least one commercial embodiment, wraps 10 are produced and sold with different diameters (radii), wherein wraps 10 for use with wine bottles 100 are produced with a radius of between 1¼ inches and 1½ inches and preferably of between 1.3 inches and 1.4 inches in their natural or default state.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claim(s) appended hereto and the equivalents thereof.

What is claimed is:

1. A method of decorating a bottle or other object having a diameter, comprising:

(a) producing a flat body of a thin resilient material;

(b) curving the flat body to produce a thin resilient planar body that forms a structure resembling a portion of a cylinder, the body having a top, a bottom, two sides that are separated by a linear gap, an outer surface, and an inner surface, wherein:

(i) in a first state, the cylindrical structure that is partially formed by the body is in a natural or default state and has a first radius and the gap has a first length, (ii) in a second state, the cylindrical structure that is partially formed by the body is in a spread state and has a second radius, the second radius being greater than the first radius, and the gap has a second length, the second length being greater than the first length and (iii) in a third state, the cylindrical structure that is partially formed by the body is in a partially-spread mounting state and has a third radius, the third radius being greater than the first radius but less than the second radius, and the gap has a third length, the third length being greater than the first length but less than the second length;

(c) applying a decorative treatment to the outer surface of the body;

(d) with the cylindrical structure in the first state, spreading the sides of the body open such that the cylindrical structure that is partially formed by the body is in the second or spread state and has the second radius and the gap has the second length, the second length being at least as large as the diameter of the bottle or other object;

(e) with the cylindrical structure in the second state, maneuvering a side of the bottle or other object through the gap until the bottle or other object is contained within the cylindrical structure; and (f) thereafter releasing the body until the cylindrical structure that is partially formed by the body is in the third or partially-spread mounting state, and has the third radius, such that the wrap is mounted around the bottle or other object and held in place by forces created by the bias of the resilient body against the bottle or other object.

2. The method of claim 1, wherein the step of producing a flat body includes producing a rectangular flat body of uniform cross-section, and wherein the step of applying a decorative treatment to the outer surface of the body includes maintaining the uniform cross-section of the body.

3. The method of claim 2, wherein the cylindrical structure has a uniform cross-section from top to bottom.

4. The method of claim 2, further comprising a step of rounding the corners of the rectangular flat body.

* * * * *